US005374203A

United States Patent [19]

Sato et al.

[11] Patent Number: 5,374,203

[45] Date of Patent: Dec. 20, 1994

[54] EDGE CONNECTOR AND BOARD LATCHING DEVICE FOR A CONNECTOR

[75] Inventors: Yoshio Sato; Takashi Kamono, both of Kanagawa; Ryoji Nishimura, Tokyo; Tsutomi Nakamura, Kanagawa; Naoki Kumagai, Tokyo, all of Japan

[73] Assignee: The Whitaker Corporation, Wilmington, Del.

[21] Appl. No.: 178,484

[22] Filed: Jan. 6, 1994

Related U.S. Application Data

[60] Continuation of Ser. No. 932,400, Aug. 19, 1992, abandoned, which is a division of Ser. No. 689,031, May 24, 1991, Pat. No. 5,161,994.

[30] Foreign Application Priority Data

Sep. 22, 1989 [JP] Japan ..... 1-246950
Aug. 15, 1990 [WO] WIPO ..... PCT/US90/04787

[51] Int. Cl.[5] ..... H01K 13/62
[52] U.S. Cl. ..... 439/326; 439/65
[58] Field of Search ..... 439/59, 62, 65, 326–328, 439/372, 350, 351, 358, 152–160

[56] References Cited

U.S. PATENT DOCUMENTS

| | | | |
|---|---|---|---|
| 2,825,037 | 2/1958 | French | 339/17 |
| 2,942,229 | 6/1960 | Berger | 339/176 |
| 3,149,897 | 9/1964 | Martineck | 339/176 |
| 3,270,313 | 8/1966 | Sautois | 339/176 |
| 3,803,533 | 4/1974 | Taplin | 339/91 |
| 3,993,390 | 11/1976 | Eigenbrode | 339/91 |
| 4,057,879 | 11/1977 | Eigenbrode | 24/230 |
| 4,074,928 | 2/1978 | Johnston | 339/91 |
| 4,113,179 | 9/1978 | McKee | 339/91 |
| 4,145,103 | 3/1979 | Knowles | 339/99 |
| 4,188,083 | 2/1980 | Knowles | 339/99 |
| 4,245,879 | 1/1981 | Buck | 339/91 |
| 4,296,989 | 10/1981 | Larson et al. | 339/99 |
| 4,521,063 | 6/1985 | Milc | 339/17 |
| 4,579,411 | 4/1986 | Cobaugh et al. | 339/75 |
| 4,621,885 | 11/1986 | Szczesny et al. | 339/91 |
| 4,641,902 | 2/1987 | Fusselman | 339/91 |
| 4,669,801 | 6/1987 | Worth | 439/404 |
| 4,693,533 | 9/1987 | Szczesny et al. | 439/350 |
| 4,697,832 | 10/1987 | Dickirson | 285/319 |
| 4,713,013 | 12/1987 | Regnier et al. | 439/62 |
| 4,726,783 | 2/1988 | Nakazawa et al. | 439/350 |
| 4,735,583 | 4/1988 | Rudy, Jr. et al. | 439/350 |
| 4,762,505 | 8/1988 | Asick et al. | 439/347 |
| 4,838,808 | 6/1989 | Fujiura | 439/357 |
| 4,872,853 | 10/1989 | Webster | 439/327 |
| 4,898,540 | 2/1990 | Saito | 439/153 |
| 4,941,849 | 7/1990 | Fujiura | 439/610 |
| 4,961,711 | 10/1990 | Fujiura et al. | 439/357 |
| 4,986,765 | 1/1991 | Korsunsky et al. | 439/326 |
| 4,995,825 | 2/1991 | Korsunsky et al. | 439/328 |
| 5,004,429 | 4/1991 | Yagi et al. | 439/326 |
| 5,013,257 | 5/1991 | Korsunsky et al. | 439/326 |
| 5,112,242 | 5/1992 | Choy et al. | 439/326 |

FOREIGN PATENT DOCUMENTS 63-137477 9/1988 Japan .

OTHER PUBLICATIONS

"Spring Retainer for Retention of Cable Connector", G. E. Meyer, IBM Technical Disclosure Bulletin, vol. 20, No. 5, Oct. 1977.

"Eighth Annual Connector Synmposium Proceedings," Electrical Connector Study Group, Inc., Oct. 1975.

*Primary Examiner*—David H. Pirlot
*Attorney, Agent, or Firm*—Bruce J. Wolstoncroft

[57] ABSTRACT

An edge connector (1) having metal latching devices (5) to latch and unlatch a circuit board (4) is disclosed. More particularly the latching devices (5) include a latching section (53) for latching the board (4) and an unlatching section (54) for releasing the board (4).

36 Claims, 7 Drawing Sheets

EDGE CONNECTOR AND BOARD LATCHING DEVICE FOR A CONNECTOR

This application is a continuation of application Ser. No. 07/932,400 filed Aug. 19, 1992, now abandoned, in turn, a divisional of application Ser. No. 07/689,031 filed May 24, 1991, U.S. Pat. No. 5,161,994.

The present invention relates to an electrical connector, more specifically to an edge connector for a PCB (printed circuit board) and a board latching device to be used with such connector.

An edge connector mounted on a PCB for interconnecting another PCB contains a plurality of contacts along the longitudinal direction thereof for receiving the edge of the another PCB. The edge connector is provided with latching means to latchably hold both edges of the PCBs. Conventionally, the latching means is made from a plastic material and is integral with the connector housing. However, such latching means, made integrally with the housing, are plastic and have inherent problems in that frequent latching and unlatching causes the latching or engaging sections to wear and reduce the latching force to an impractical level.

One approach to solve the above problems may be the use of separate metal members to be mounted on a housing. A metal latch is generally stronger in latching force and more durable. However, it requires additional force when unlatching the PCB. It is especially difficult to unlatch a PCB in an electronic apparatus or the like having a plurality of closely disposed connectors.

It is now proposed to provide a connector having latching devices with improved latching force, durability and unlatching of the PCB and a board latching device for such connector.

The edge connector according to the present invention is an edge connector for interconnecting two PCBs comprising an insulation housing having a plurality of contacts along the longitudinal direction and openings at both ends, and a pair of board latching devices to be inserted and secured in the openings in the insulation housing. Each of the board latching devices is made of a metal plate member comprising a latching section to latch the second circuit board and an unlatching section to release the latching of the second circuit board.

Additionally, the board latching device for a connector according to the present invention is integrally made of a metal plate member. It features the provision of a retaining section to mount in an opening in an insulation housing of a connector, a board latching section to latch a circuit board and an unlatching section to externally release the latching of the circuit board by the board latching section. That is, the board latching devices are secured in the openings in the connector housing and provided with the unlatching section outside of the board latching section for releasing the latching of the PCB by the board latching section through external finger operation.

An embodiment of the present invention will be described in detail hereunder by reference to the accompanying drawings.

Figure 1:
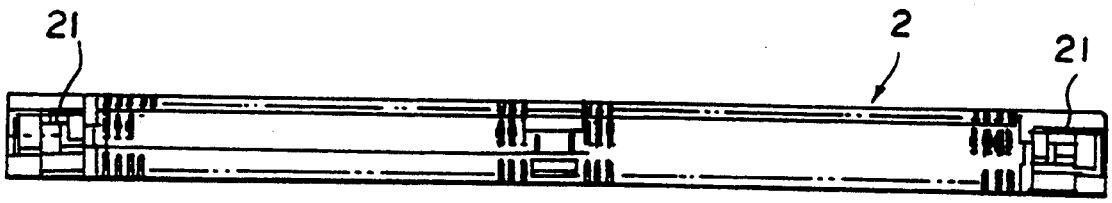
FIG. 1 is a plan view of the housing for the edge connector according to the present invention.
Figure 2:
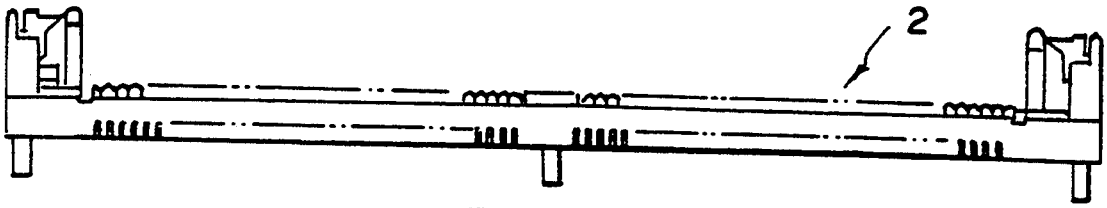
FIG. 2 is a front view of the housing in FIG. 1.
Figure 3:
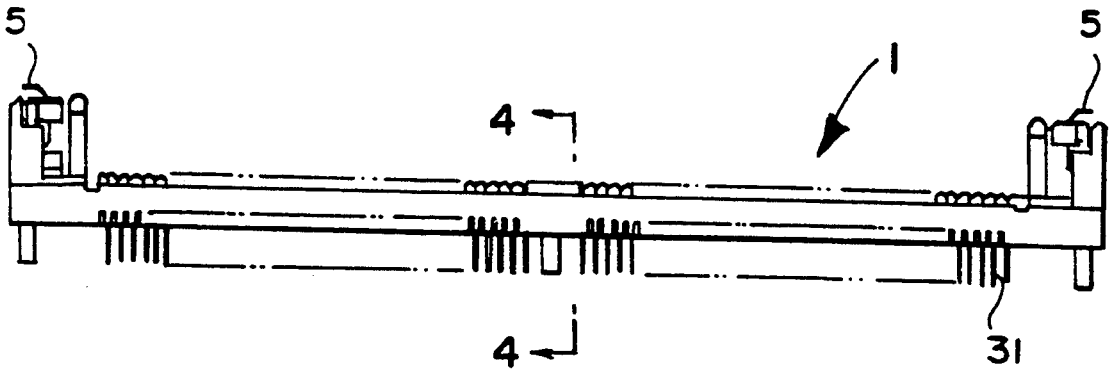
FIG. 3 is a front view of the housing having board latching devices and contacts installed therein.
Figure 4:
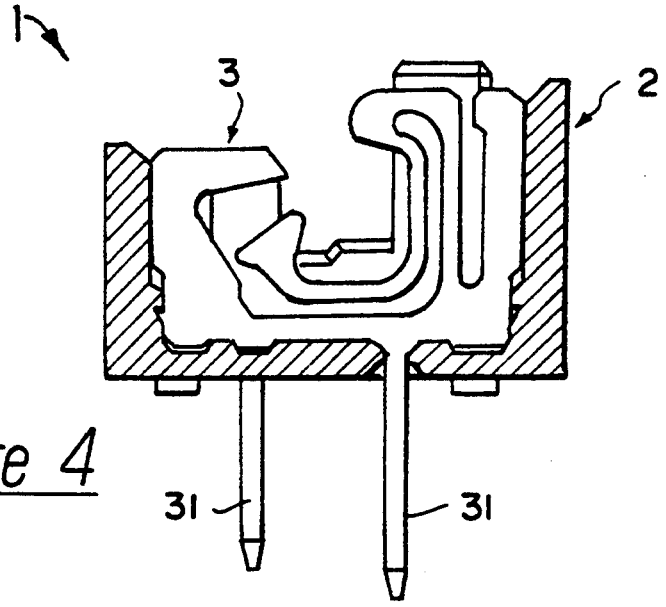
FIG. 4 is an enlarged cross sectional view along the line IV—IV in FIG. 3.

Illustrated in FIGS. 1, 2 and 3 are respectively a plan view, a front view, and a front view of an insulation housing 2 of the edge connector 1 of FIG. 3. Housing 2 has a large number of contacts 3 (see FIG. 4) inserted in parallel with each other along the longitudinal direction thereof. Each contact 3 has a tine 31 extending outwardly from the bottom of the housing 2 for making electrical connection with one of two PCBs.

Figure 19:
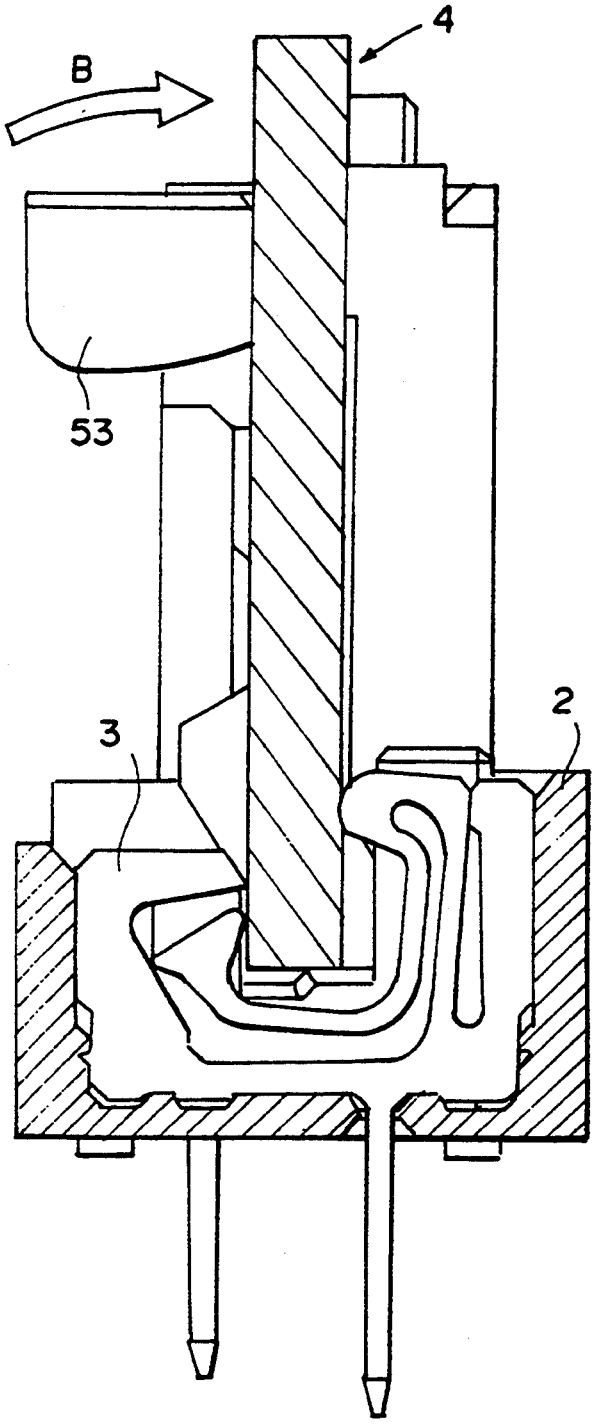
FIG. 19 is a cross sectional view of FIG. 18 further having a circuit board mounted thereon.

There are two openings 21 at both ends of the housing 2 to insert and secure board latching devices 5 for latching another circuit board (as referred to by a reference number 4 in FIG. 19). The detailed construction of the both ends is discussed hereinafter by reference to FIGS. 5 through 9. Also, the detailed construction of the board latching devices 5 will be illustrated in FIGS. 10 through 16.

Figure 5:
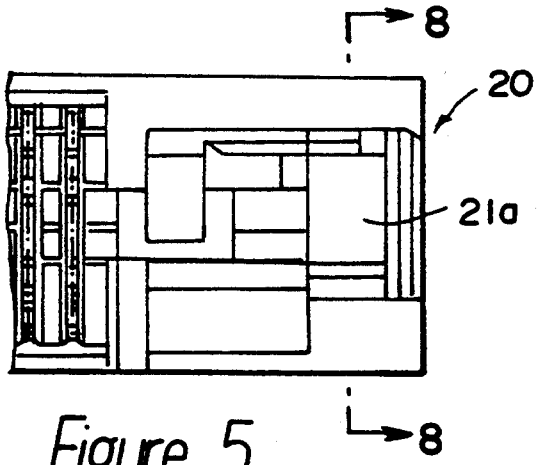
FIG. 5 is a partial enlarged view of the right hand portion of the above housing.
Figure 6:
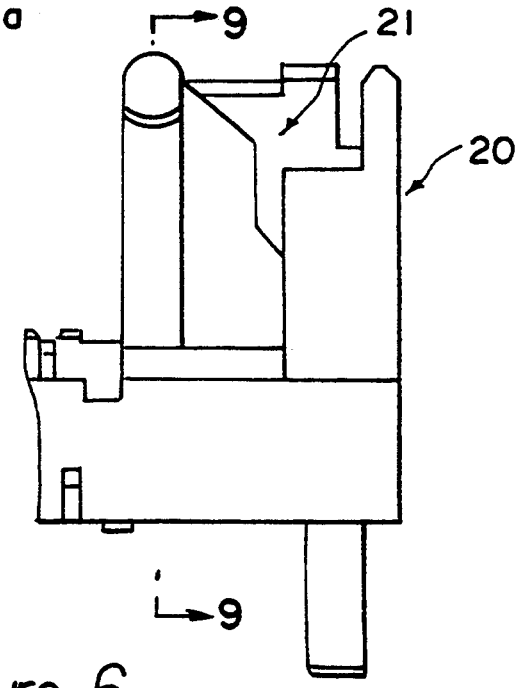
FIG. 6 is the front view of FIG. 5.
Figure 7:
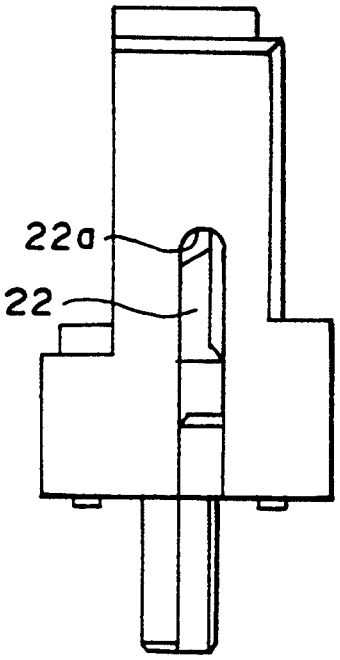
FIG. 7 is the right side view of FIG. 5.
Figure 9:
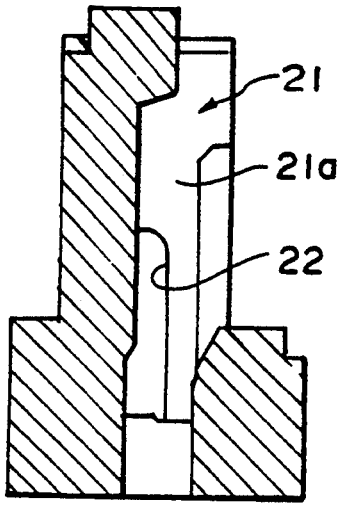
FIG. 9 is a cross sectional view along the line IX—IX in FIG. 6.
Figure 8:
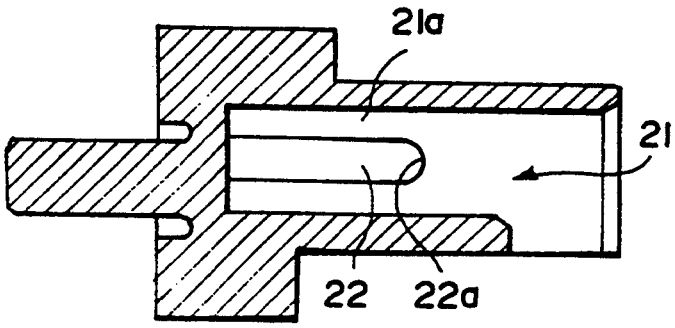
FIG. 8 is a cross sectional view along the line VIII—VIII in FIG. 5.
Figure 17:
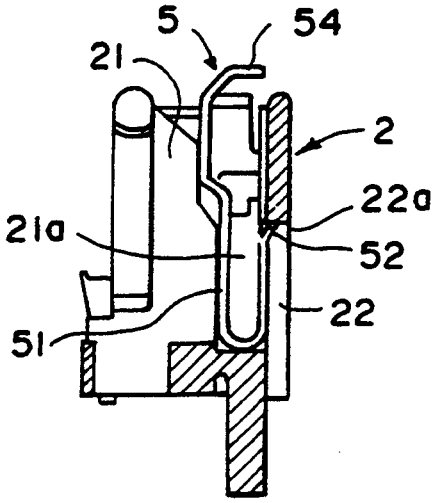
FIG. 17 is a cross sectional view of the edge portion of the housing having the board latching device secured in the opening thereof.
Figure 18:
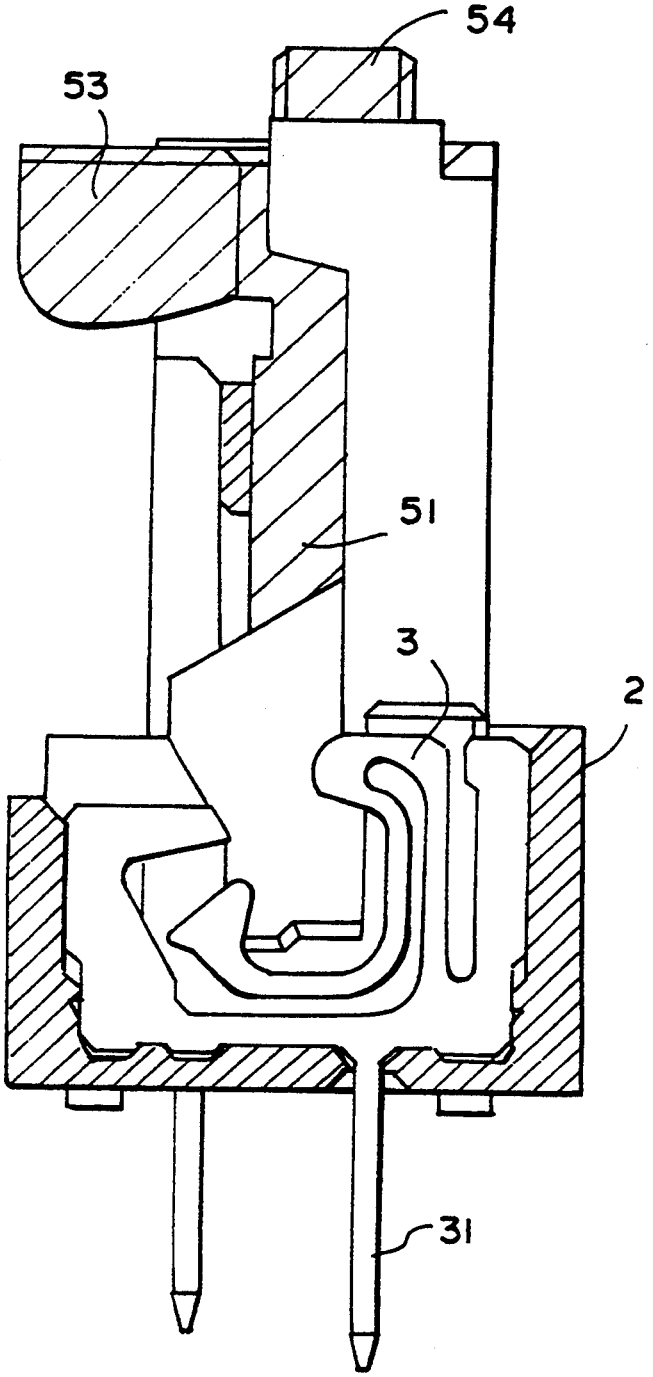
FIG. 18 is a central cross sectional view of the housing having the contacts and the board latching device installed therein (with the latching device hatched)

As illustrated in FIGS. 5 through 9, there are symmetrically formed a pair of openings 21 to receive and retain the latching devices 5 therein. Illustrated in FIG. 5 is the right hand end portion in FIGS. 1 through 3. FIGS. 5, 6 and 7 illustrate plan, front and right side views, respectively. FIG. 8 is a cross sectional view along the line VIII—VIII in FIG. 5 and FIG. 9 is a cross sectional view along the line IX—IX in FIG. 6. The opening 21 has an elongated receiving cavity **21*a* for receiving base section 51 of the metal latching device 5 as illustrated in FIGS. 10 through 16. A slot portion 22 (see FIG. 17) having a step portion 22*a* is provided to engage with a hook portion 52 of the latching device 5 inserted in the opening 21 from the above, thereby preventing the latching device 5** from being pulled out in the above direction.

The board latching device 5 is made of a metal plate member and has a board latching section 53 extending laterally with a curved surface **53*a* above a U-shaped (in cross section) base section 51 having the above mentioned hook section 52. It also has an unlatching section 54 extending horizontally above the board latching section 53. The unlatching section 54 allows the upper half portion of the latching device 5 as well as the latching section 53 to deform sideways (in the direction A) by pushing it down by a finger, thereby releasing the circuit board 4 latched by the latching section 53**.

Figure 10:
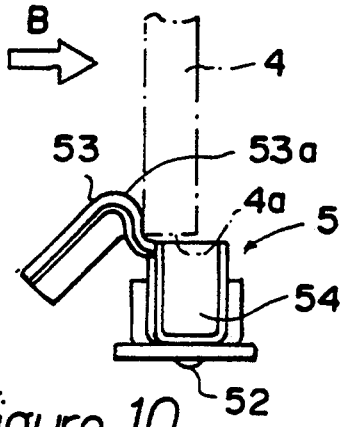
FIG. 10 is a plan view of the board latching device used in the above embodiment.
Figure 11:
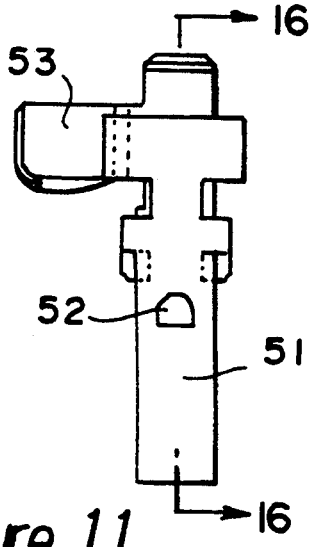
FIG. 11 is the right side view of FIG. 10.
Figure 12:
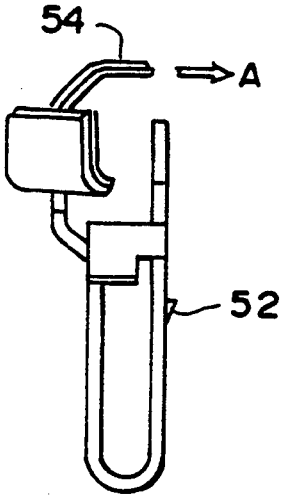
FIG. 12 is the front view of FIG. 10.
Figure 13:
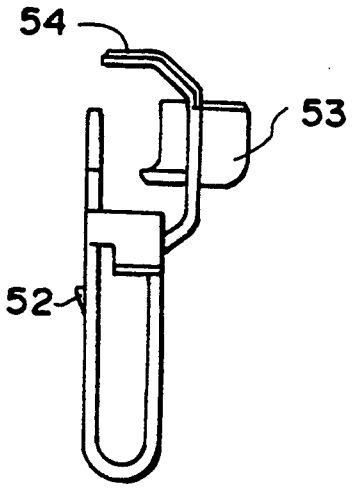
FIG. 13 is the back view of FIG. 10.
Figure 14:
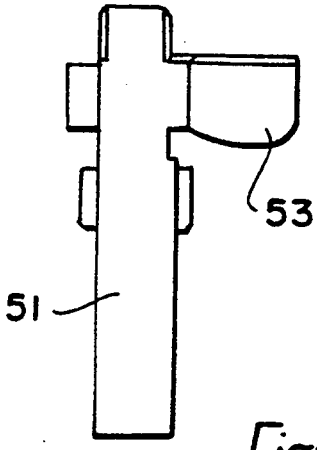
FIG. 14 is the left side view of FIG. 10.
Figure 15:
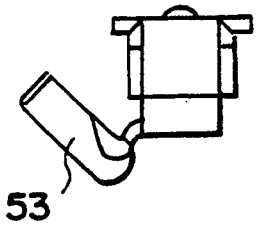
FIG. 15 is the bottom view of FIG. 10.
Figure 16:
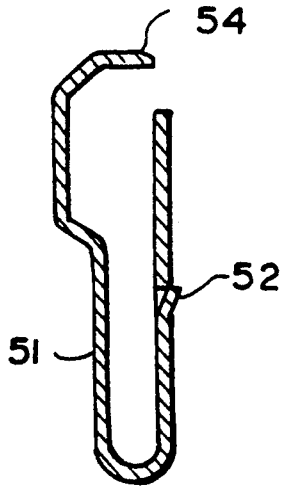
FIG. 16 is a cross sectional view along the line XVI—XVI in FIG. 11.

When the circuit board 4 is inserted in the direction B in FIG. 10, a side edge 4*a* of the circuit board 4 rides over the curved surface 53*a* of the latching section 53 (by resiliently bending the upper half of the latching device 5) for engagement with the latching section 53. In this manner, the edge of the circuit board 4 is received in the contacts 3 in the housing 2 for making electrical connection.

In order to unlatch the circuit board 4, the unlatching section 54 is pushed sideward from the above, thereby resiliently deforming the upper half of the latching device 5 outwardly from the engaging location of the latching section 53 with the circuit board 4.

As mentioned above, the connector according to the present invention is made of a metal plate member and comprises the retaining section (the hook section 52 on the base section 51) for mounting on the housing 2, the latching section 53 for engaging with the circuit board 4 and the unlatching section 54 for releasing the engagement. It is, therefore, excellent in mechanical strength, durable and easy to remove the circuit board 4 by simply pushing the unlatching section 54 by a finger.

The formation of the curved surface 53*a* at the latching section 53 allows the engagement with the circuit board 4 to be released by guiding the side edge of the circuit board 4 along the curved surface 53*a* even if an excessive force is applied to the circuit board 4 from the back side of the connector (e.g., when the operator pushed the circuit board 4 from the back side of the connector by mistake). This is important to prevent the board latching devices 5 and the retaining sections therefor in the housing 2 from being broken.

It should be understood that the shape of the board latching device may not be limited to the particular embodiment and may be modified in many ways without departing from the spirit of the invention as long as the above mentioned functions are maintained.

We claim:

1. An electrical connector for connecting a daughter card with a mother board, the daughter card being rotatable relative to the mother board between a first and second position, the electrical connector comprising:

an insulating housing;

a plurality of contacts disposed along the longitudinal axis of the housing; and a separate resilient latch which cooperates with the daughter card to maintain the daughter card in the second position, the latch having a latching section and an unlatching section, the unlatching section extending above the latching section.

2. The electrical connector of claim 1 wherein the latch includes a substantially U-shaped base section.

3. The electrical connector of claim 1 wherein the unlatching section extends toward an adjacent end of the housing.

4. The electrical connector of claim 3 wherein the unlatching section extends substantially horizontally to the longitudinal axis of the housing.

5. The electrical connector of claim 3 wherein the unlatching section extends substantially perpendicularly to the latching section.

6. The electrical connector of claim 1 wherein the housing further comprises a latch receiving recess adjacent at least one end of the housing.

7. The electrical connector of claim 6 wherein the latch receiving recess is defined by a base and at least one wall.

8. The electrical connector of claim 6 wherein the latch receiving recess is defined by a base and four walls.

9. The electrical connector of claim 1 wherein the housing further comprises a latch receiving opening adjacent at least one end of the housing.

10. The electrical connector of claim 7 wherein the latch receiving opening is defined by four walls.

11. An electrical connector for connecting a daughter card with a mother board, the daughter card being rotatable relative to the mother board between a first and second position, the electrical connector comprising:

an insulating housing;

a plurality of contacts disposed along the longitudinal axis of the housing;

a latch receiving area adjacent at least one end of the housing;

a separate resilient latch which cooperates with the daughter card to maintain the daughter card in the second position, the latch being positioned in the latch receiving area, the latch having a latching section and an unlatching section, the unlatching section extending above the latching section.

12. The electrical connector of claim 11 wherein the latch includes a substantially U-shaped base section.

13. The electrical connector of claim 11 wherein the unlatching section extends toward an adjacent end of the housing.

14. The electrical connector of claim 13 wherein the unlatching section extends substantially horizontally to the longitudinal axis of the housing.

15. The electrical connector of claim 13 wherein the unlatching section extends substantially perpendicularly to the latching section.

16. The electrical connector of claim 11 wherein the latch receiving area comprises a recess.

17. The electrical connector of claim 16 wherein the recess is defined by a base and at least one wall.

18. The electrical connector of claim 16 wherein the recess is defined by a base and four walls.

19. An electrical connector for connecting a daughter card with a mother board, the daughter card being rotatable relative to the mother board between a first and second position, the electrical connector comprising:

an insulating housing having a latch receiving are near each end of the housing;

a plurality of contacts disposed along the longitudinal axis of the housing; and a pair of separate resilient latches which cooperate with the daughter card to maintain the daughter card in the second position, each latch being positioned within a latch receiving area, each latch having a latching section and an unlatching section, the unlatching section extending above the latching section.

20. The electrical connector of claim 19 wherein the latch includes a substantially U-shaped base section.

21. The electrical connector of claim 19 wherein the unlatching section extends toward an adjacent end of the housing.

22. The electrical connector of claim 21 wherein the unlatching section extends substantially horizontally to the longitudinal axis of the housing.

23. The electrical connector of claim 21 wherein the unlatching section extends substantially perpendicularly to the latching section.

24. The electrical connector of claim 19 wherein the latch receiving area comprises a recess.

25. The electrical connector of claim 24 wherein the recess is defined by a base and at least one wall.

26. The electrical connector of claim 24 wherein the recess is defined by a base and four walls.

27. An electrical connector for connecting a daughter card with a mother board, the daughter card being rotatable relative to the mother board between a first and second position, the electrical connector comprising:

an insulating housing;

a plurality of contacts disposed along the longitudinal axis of the housing; and a separate resilient latch which cooperates with the daughter card to maintain the daughter card in the second position, the latch having a latching section and an unlatching section, the unlatching section extending above the latching section and toward an adjacent end of the housing, whereby a force applied to the unlatching section substantially perpendicular to the longitudinal axis of the housing causes the latching section to move away from the daughter card.

28. The electrical connector of claim 27 wherein the latch includes a substantially U-shaped base section.

29. The electrical connector of claim 27 wherein the unlatching section extends substantially horizontally to the longitudinal axis of the housing.

30. The electrical connector of claim 27 wherein the unlatching section extends substantially perpendicularly to the latching section.

31. The electrical connector of claim 27 wherein the housing further comprises a latch receiving area adjacent at least one end of the housing.

32. The electrical connector of claim 31 wherein the latch receiving area comprises a recess.

33. The electrical connector of claim 32 wherein the recess is defined by a base and at least one wall.

34. The electrical connector of claim 32 wherein the recess is defined by a base and four walls.

35. The electrical connector of claim 31 wherein the latch receiving area comprises an opening.

36. The electrical connector of claim 35 wherein the opening is defined by four walls.

* * * * *

UNITED STATES PATENT AND TRADEMARK OFFICE

CERTIFICATE OF CORRECTION

PATENT NO. : 5,374,203
DATED : December 20, 1994
INVENTOR(S) : Yoshio Sato, et. al.

It is certified that error appears in the above-indentified patent and that said Letters Patent is hereby corrected as shown below:

Title page, item [75], inventors: in the third line, delete "Tsutomi" and substitute --Tsutomu--.
Column 4, claim 10, line 1, delete "7" and substitute --9--.
Column 4, claim 6, delete "are" and substitute --area--.

Signed and Sealed this

Twenty-eight Day of March, 1995

*Attest:*

Bruce Lehman

BRUCE LEHMAN

*Attesting Officer*

*Commissioner of Patents and Trademarks*